US005947699A

United States Patent [19]

Cooke

[11] Patent Number: 5,947,699

[45] Date of Patent: Sep. 7, 1999

[54] ELECTROMAGNETICALLY CONTROLLED RADIAL PISTON PUMP

[75] Inventor: Michael Peter Cooke, Gillingham, United Kingdom

[73] Assignee: Lucas Industries Plc, United Kingdom

[21] Appl. No.: 08/895,623

[22] Filed: Jul. 17, 1997

[30] Foreign Application Priority Data

Jul. 22, 1996 [GB] United Kingdom ..... 9615359

[51] Int. Cl.[6] ..... F04B 1/04

[52] U.S. Cl. ..... 417/273; 417/297

[58] Field of Search ..... 417/273, 297; 74/49; 92/246

[56] References Cited

U.S. PATENT DOCUMENTS

| | | | |
|---|---|---|---|
| 2,271,570 | 2/1942 | Pardee | 103/174 |
| 2,770,972 | 11/1956 | Gratzmuller | 74/49 |
| 3,994,208 | 11/1976 | Boyer | 92/246 |
| 4,082,072 | 4/1978 | Johnson | 123/139 AA |
| 4,505,648 | 3/1985 | Heger et al. | 417/297 |
| 4,874,297 | 10/1989 | Collins | 417/265 |
| 5,131,818 | 7/1992 | Wittkop et al. | 417/273 |
| 5,167,493 | 12/1992 | Kobari | 417/273 |
| 5,382,140 | 1/1995 | Eisenbacher | 417/273 |
| 5,642,988 | 7/1997 | Zorn | 417/273 |

FOREIGN PATENT DOCUMENTS

| | | |
|---|---|---|
| 01294958 | 11/1989 | European Pat. Off. . |
| 72.07011 | 10/1973 | France . |
| 2920 702 | 5/1979 | Germany . |
| 3803735 A1 | 8/1989 | Germany . |

*Primary Examiner*—Charles G. Freay
*Assistant Examiner*—Robert Z. Evora
*Attorney, Agent, or Firm*—David P. Gordon; David S. Jacobson; Thomas A. Gallagher

[57] ABSTRACT

Fuel pump for delivering high pressure fuel to a fuel injection system of an internal combustion engine is provided. The fuel pump has a body, a drive shaft rotatably mounted in the body, at least one cam on the drive shaft, a plurality of pumping plungers mounted in the body for movement in the radial direction relative to the axis of rotation of the drive shaft, a pumping chamber defined radially outwardly of each plunger, and a delivery valve associated with each pumping chamber. Each pumping plunger is mounted in a support member which provides sliding support for its associated plunger in the circumferential direction of the drive shaft over substantially the entire length of the plunger in all working positions thereof. Each plunger is coupled to at least one cam by a pin which is secured to the plunger and extends outwardly from the plunger through a slot which extends through the support member in the axial direction of the drive shaft. This arrangement obviates the need, which exists in conventional radial piston pumps, for the piston to extend outwardly of the member in which it is mounted to engage with the cam or the cam follower.

17 Claims, 3 Drawing Sheets

ELECTROMAGNETICALLY CONTROLLED RADIAL PISTON PUMP

BACKGROUND OF THE INVENTION

This invention relates to a fuel pump, and more particularly to a fuel pump for delivering high pressure fuel to a fuel injection system of an internal combustion engine. The preferred embodiment of the present invention is particularly suitable for supplying high pressure fuel to an accumulator or directly to the common rail of a common rail fuel injection system, but the invention is not limited to this application.

SUMMARY OF INVENTION

According to one aspect of the present invention a fuel injection pump comprises a body; a drive shaft rotatably mounted in the body; at least one cam on the drive shaft; a plurality of pumping plungers mounted in the body for movement in the radial direction relative to the axis of rotation of the drive shaft; a pumping chamber wherein each plunger; and a delivery valve associated with each pumping chamber wherein each pumping plunger is mounted in a support member which provides sliding support for its associated plunger in the circumferential direction of the drive shaft over substantially the entire length of the plunger in all working positions thereof, and each plunger is coupled to the cam by a pin which is secured to the plunger and extends outwardly from the plunger through a slot which extends through the support member in the axial direction of the drive shaft.

By providing a slot, extending in the axial direction of the drive shaft, in the support member, the pumping plunger can be connected to the cam using a pin. This obviates the need, which exists in conventional radial piston pumps, for the piston to extend outwardly of the member in which it is mounted to engage with the cam or a cam follower. Accordingly, each pumping plunger may be supported by its support member along the face thereof which faces in the circumferential (rotational) direction of the drive shaft over substantially its entire length.

According to another aspect of the present invention a fuel pump comprises at least one pumping plunger mounted for reciprocating movement within a cylinder member to vary the size of a pumping chamber which is defined by the cylinder member and bounded at one end by the pumping plunger wherein the end of the pumping plunger which bounds the pumping chamber is provided with a blind hole which extends into the plunger to define an annular skirt at the end of the plunger which bounds the pumping chamber whereby fuel pressure in the pumping chamber will apply a force radially outwardly to the surface of the blind hole to expand the annular skirt radially to maintain sliding sealing contact between the plunger and the cylinder member in the event of dilation of the cylinder member by fuel pressure.

According to another aspect of the present invention a fuel pump comprises: a cylinder; a pumping plunger mounted in the cylinder; a pumping chamber defined within the cylinder and bounded at one end by the pumping plunger; drive means for reciprocatably driving the plunger within the cylinder to vary the volume of the pumping chamber; and a delivery valve which can be opened by fuel pressure in the pumping chamber to permit delivery of high pressure fuel therefrom, wherein in that a holding device is provided which is capable of selectively maintaining the delivery valve open at the end of each delivery stroke of the plunger and for at least part of the subsequent filling stroke of the plunger whereby a selected proportion of the fuel delivered through the delivery valve during each pumping stroke of the plunger is allowed to return to the pumping chamber during the succeeding filling stroke of the plunger.

Preferably, the fuel injection pump comprises a plurality of, for example three, pumping plungers. The holding device is preferably in the form of an electromagnet which is capable of holding the delivery valve closure member in its open position. Preferably, the electromagnet is insufficiently powerful to open the delivery valve if the valve member is seated and the plunger is executing a filling stroke. Under these circumstances, if the pump is provided with three plungers located rotationally 120° out of phase with each other, the three electromagnets may be operated simultaneously in order to provide the desired control of the delivery valves. The electromagnets will be energised close to the end of the delivery stroke of one pumping plunger to maintain the delivery valve member associated with that plunger open. At this point, one of the other two plungers will be beginning its delivery stroke and accordingly its associated delivery valve will be open and the energisation of the associated electromagnet will have no effect. The third pumping plunger will be somewhere towards the end of its filling stroke and the associated electromagnet will be insufficiently powerful to open the delivery valve against the loading of the output pressure against the closed valve member.

Preferably, the slot in the support member associated with each plunger provides a filling port for the associated pumping chamber. Accordingly, the geometry of the cam is so arranged that the radially outer edge of each pumping plunger comes into register with the slot in its associated support member during each filling stroke to permit fuel to flow through the slot into the pumping chamber.

Preferably, the pins which are secured to the pumping plungers are coupled to the cam by means of a carrier which is rotatably mounted on the cam and to which the pins are connected. Preferably, for each pumping plunger the carrier provides a flat sliding surface for acting on the pin. The pin may directly engage the sliding surface but in the preferred embodiment a sliding shoe is secured to the pin and the sliding shoe itself contacts the sliding surface of the carrier. Means are provided acting on the sliding shoe to maintain the sliding shoe in contact with the sliding surface of the carrier during filling strokes of the plungers. Such means can conveniently comprise one or more spring clips secured to the carrier and acting on the sliding shoe of each plunger.

The invention will be better understood from the following description of a preferred embodiment thereof, given by way of example only, reference being had to the accompanying drawings.

DETAILED DESCRIPTION OF THE PREFERRED EMBODIMENTS

Figure 1:
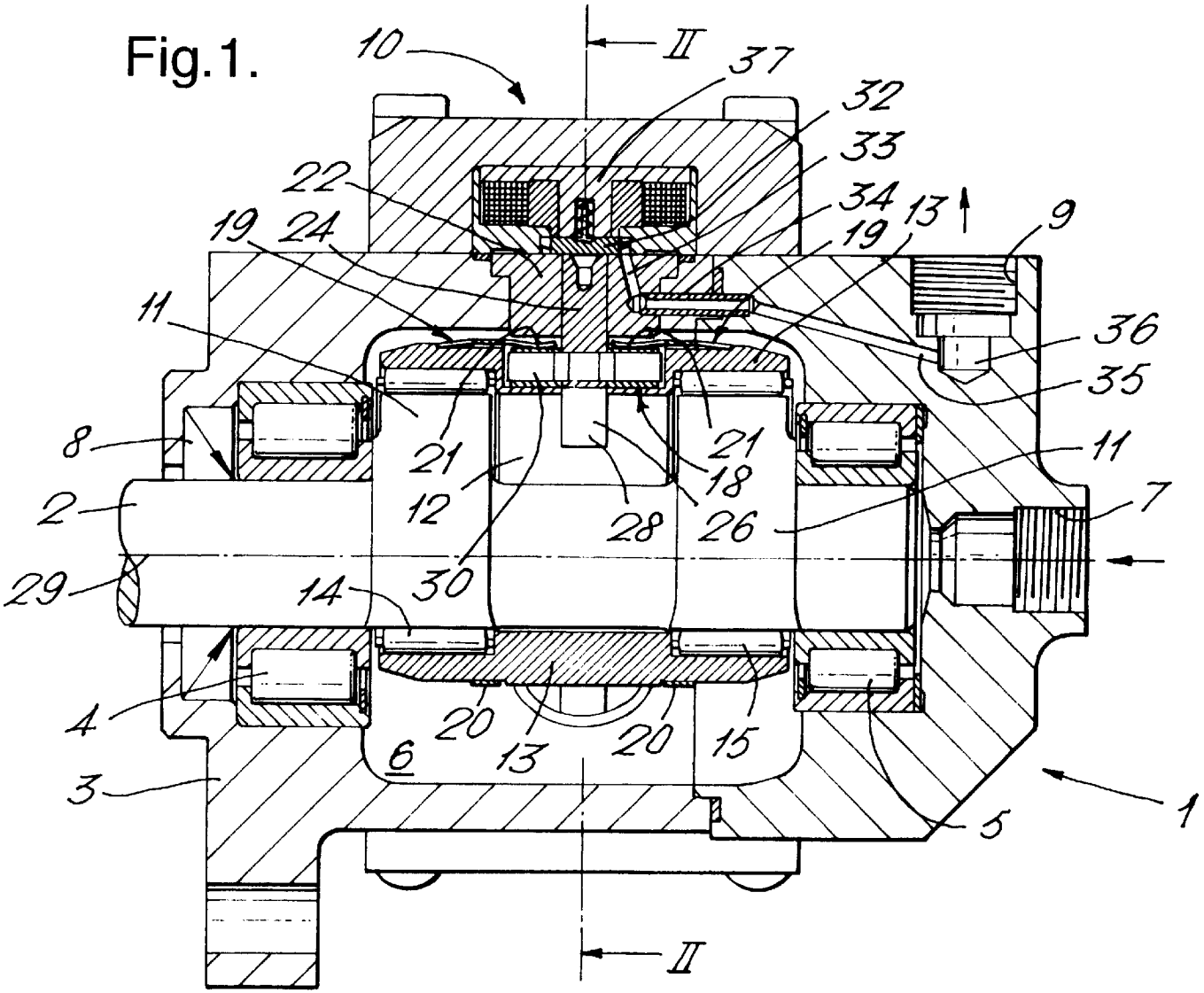
FIG. 1 is a schematic longitudinal cross-sectional view of an embodiment of fuel pump according to the present invention.

The fuel pump 1 shown in the drawing is suitable for supplying high pressure fuel to an accumulator or directly to the common rail of a common rail fuel injection system. The pump 1 has a drive shaft 2 which is connected to an appropriate source of input power, for example the cam shaft of an internal combustion engine. The drive shaft 2 is mounted for rotation within a body 3 by bearings 4,5. A chamber 6 is defined within the body, and in use, is filled with fuel received via an inlet 7 from a suitable source, for example a transfer pump. The chamber 6 is sealed at the end of the body opposite the inlet 7 by a seal 8. High pressure fuel is delivered by the pump through an outlet 9.

The illustrated pump includes three pumping assemblies 10 secured to the body 3 and located spaced angularly 120° from each other. It should be appreciated, however, that the invention is not limited to pumps incorporating three pumping assemblies and, depending on the required characteristics of the fuel injection system supplied by the pump, more or less than three pumping assemblies may, in certain circumstances, be appropriate.

Figure 2:
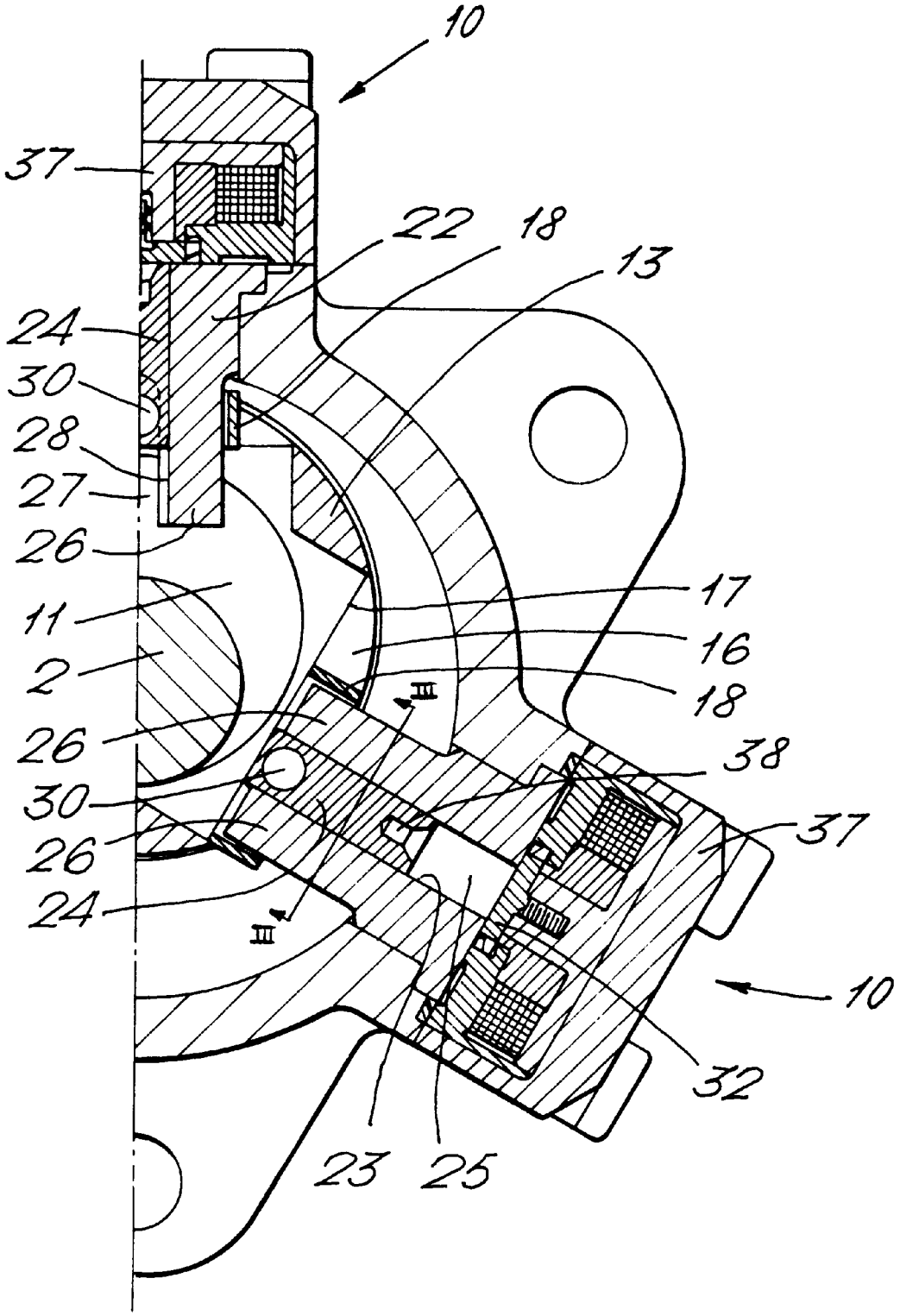
FIG. 2 is a half transverse transection of FIG. 1 on the line II—II thereof.
Figure 3:
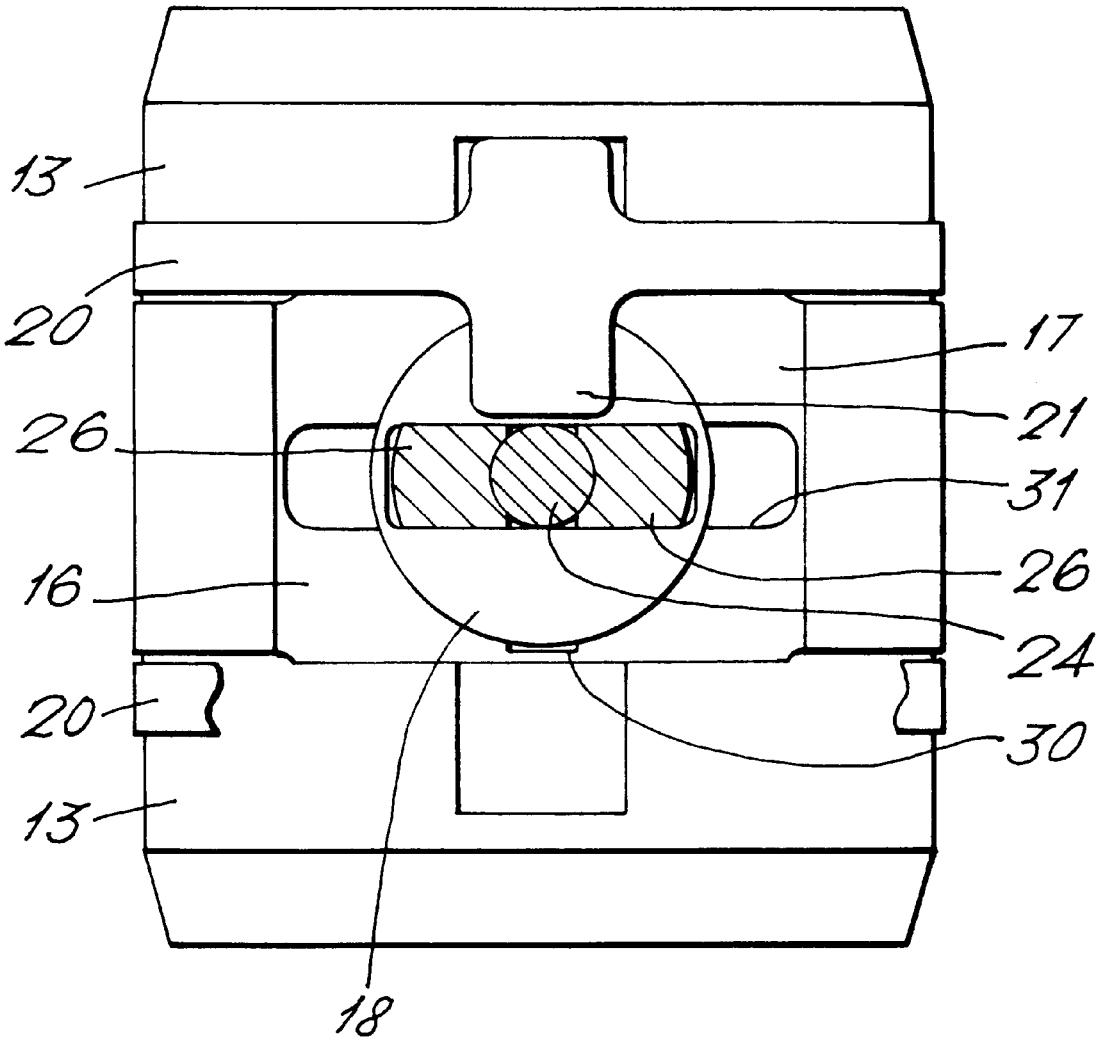
FIG. 3 is a schematic part-sectioned view across line III—III in FIG. 2 of a portion of the embodiment of FIGS. 1 and 2.

The drive shaft 2 is provided with a pair of identical cams 11 which are rotationally in phase with each other and are spaced apart axially on the drive shaft 2 to provide a space 12 there between. A carrier 13 is mounted on the cams 11 by bearings 14, 15. As best seen in FIGS. 2 and 3, the carrier 13 is formed, in the zone of each pumping assembly 10, with a recess 16 having a flat bottom 17. Each recess 16 has mounted therein a shoe 18 for sliding movement along the flat bottom 17 as the drive shaft rotates. As seen in FIG. 1, the shoes 18 are constrained to remain in sliding contact with the flat bottom 17 by a pair of spring clips 19 each of which has a band 20 which surrounds the carrier 13 and fingers 21 which act on the shoes 18.

As seen in FIG. 3, each pumping assembly 10 comprises a barrel 22 which defines a cylinder 23 in which is mounted a pumping plunger 24. A pumping chamber 25 is defined by each cylinder 23 and is bounded, at the radially inner end thereof, by the radially outer end of the corresponding plunger 24.

Each barrel 22 extends radially inwardly beyond the cylinder 23 to provide a pair of arms 26 separated by a slot 27. The surfaces 28 of the arms 26 which face each other are a continuation of the surface of the cylinder 23 and accordingly the portions of each pumping plunger 24 which are located radially inwardly of the cylinder 23 are supported for sliding movement by the corresponding arms 26. The barrels 22 are orientated such that the arms 26 are located in the circumferential direction relative to the axis of rotation 29 of the shaft 2 (see FIG. 1) and accordingly the surfaces 28 of the arms provide support for the plungers 24 in the circumferential direction.

The slot 27 which separates the arms 26 extends in the direction of the axis 29 and accommodates a pin 30 the axis of which is parallel to the axis 29. Each pin 30 extends through aligned bores in its associated plunger 24 and shoe 18 to couple the plunger to the shoe. It will be appreciated that because the shoes 18 are constrained to remain in sliding contact with the flat bottoms 17 of the recesses 16 by the spring clips 19, the plungers 24 will be reciprocated in the radial direction as the drive shaft 2 is rotated and the shoes 18 will slide backwards and forwards across the corresponding recesses 16.

As seen best in FIG. 2 and 3, in order to accommodate the arms 26 each recess 16 is formed with a through slot 31.

It will be appreciated from the above description that rotation of the drive shaft 2 will reciprocate the plungers 24 to vary cyclically the volume of the pumping chambers 25 and that the plungers 24 will be supported in the circumferential direction over substantially their entire length by the cylinders 23 and arm surfaces 28 in all working positions of the plungers.

Turning now to FIG. 1 and 3, the length of the plungers 24 and the radial extent of the slots 27 are selected such that when the plungers 24 are at and close to their radially innermost positions the radially outer end of each plunger is located radially inwardly of the radially outer end of each slot 27 so as to form a pair of filling ports which allow fuel from the chamber 6 to enter the cylinder 23. The use of port filling obviates the need for an inlet valve to control admission of fuel to the pumping chambers 25. Delivery of fuel from each pumping chamber 25 is controlled by a delivery valve 32 which is spring biased into engagement with the outer surface of its associated barrel 22. Each delivery valve 32 accordingly forms the radially outer end of its associated pumping chamber 25 thereby minimising the unswept volume of each chamber 25. During each pumping stroke of each plunger 24 fuel pressure within the pumping chamber 25 lifts the delivery valve 32 and fuel is delivered to the oulet 9 via a bore 33 in the barrel 22, a transfer pipe 34, and a bore 35 in the body. The bores 35 from each pumping assembly 10 enter a common gallery 36 for delivery to the outlet 9.

It will be noted that because each pumping plunger 24 always executes a full stroke and there is no limitation on the filling of the chambers 25, each delivery stroke of each pumping plunger will always deliver a full charge of fuel through its associated delivery valve 32.

In order to control the net delivery of the pump, each pumping assembly includes an electromagnet 37 which, when energised, is capable of holding its associated delivery valve 32 in the open position. Accordingly, the electromagnets 37 are controlled so that, in any one pumping assembly, at the end of the delivery stroke of the pumping plunger 24 the electromagnet 37 is energised to hold the delivery valve 32 open for part of the return (filling) stroke of the pumping plunger. Accordingly, during this initial phase of return of the pumping plunger, fuel will flow into the pumping chamber 25 from the bore 33 via the delivery valve. At an appropriate point of the return stroke the electromagnet 37 is de-energised allowing the delivery valve 32 to close and prevent further reverse flow of fuel. It will be appreciated that by varying the point in the return stroke of the plunger 24 at which the electromagnet is de-energised the net volume of fuel delivered to the outlet 9 for each pumping cycle can be controlled.

In a particularly preferred embodiment of the invention the electromagnets 37 are incapable of opening the delivery valves 32 when those valves are shut and the associated pumping plunger is moving in the radially inward direction. If this is the case, and an appropriate number of pumping assemblies (typically three) is provided, control of the pump can be effected by simultaneously energising and de-energising all electromagnets 37. In the case of a three pumping assembly system as illustrated, at the end of the delivery stroke of one pumping plunger 24 another pumping plunger will be close to the beginning of its delivery stroke and accordingly energisation of the electromagnet associated with the delivery valve of that plunger will have no effect on the operation of that pumping assembly. The pumping plunger of the third pumping assembly will be moving radially inwardly towards the end of its filling stroke, and because the electromagnet of that pumping assembly will be insufficiently strong to open the associated delivery valve, energisation of that electromagnet will have no effect on the operation of that pumping assembly.

Control of the electromagnets 37 can by any appropriate means and can, conveniently, be controlled in light of the pressure in the accumulator or common rail. Since, for other control purposes, a pressure sensor will be provided in the accumulator or common rail the output of that pressure sensor can conveniently be used, via appropriate control circuitry, to control energisation and de-energisation of the electromagnets. Because the point of peak output pressure as detected by the pressure sensor will have a predetermined relationship to the angular position of the shaft, a signal derived from the pressure sensor can be used as a timing signal for controlling the electromagnets and no direct detection of the angular position of the shaft is required for control purposes. Of course, if desired, the angular position of the shaft can be detected directly and used in association with other control parameters to control the electromagnets 37.

It will be noted that if the electromagnets 37 are energised for sufficiently long to maintain the delivery valve 32 of any one pumping plunger open until the radially outer edge of the pumping plunger clears the radially outer-edge of its associated slot 27, a flow passage will be established from the outlet 9 to the chamber 6. This can, if required, be used to dump fuel from the outlet 9 back into the chamber 6 for the purpose, for example, of producing rapid pressure decay in a common rail system.

It will be noted that the radially outer end of each pumping plunger 24 is formed with a blind hole 38 which extends into the plunger to define an annular skirt at the end of the plunger which bounds the pumping chamber. Accordingly, fuel pressure in the chamber 25 acts radially outwardly on the skirt to expand the skirt radially into sliding sealing engagement with the wall 23 of the cylinder. Expansion of the skirt under the influence of fuel pressure enables the pumping plunger to remain in sliding sealing engagement with the wall of the cylinder even if the cylinder itself is dilated by the fuel pressure within the pumping chamber. By appropriate choice of the size and shape of the blind hole 38 a degree of elastic deformation can be obtained which results in sufficient radial expansion of the skirt to maintain a satisfactory fluid tight seal between the plunger 24 and its associated cylinder 23, without adding undesirably to the force required to move the plunger 24 during each pumping stroke.

I claim:

1. A fuel injection pump, comprising:

a) a body;

b) a drive shaft rotatably mounted in said body and having an axis of rotation;

c) at least one cam on said drive shaft;

d) a plurality of pumping plungers mounted in said body for movement in a radial direction relative to said axis of rotation of said drive shaft;

e) a plurality of support members which provide sliding support for respective pumping plungers in a circumferential direction of said drive shaft over substantially an entire length of said respective pumping plungers in all positions thereof, with each said pumping plunger coupled to at least one of said at least one cam; and f) a plurality of pumping chambers defined radially outwardly of said plurality of pumping plungers, each pumping chamber having a delivery valve, and each pumping chamber having a respective pumping plunger forming an end of said pumping chamber.

2. A fuel injection pump according to claim 1, wherein:

each said pumping plunger is coupled to at least one of said at least one cam by a pin which is secured to said pumping plunger and which extends outwardly from said plunger through a slot which extends through said support member.

3. A fuel injection pump according to claim 2, wherein:

said slot in said support member provides a filling port for its respective pumping chamber.

4. A fuel injection pump according to claim 3, wherein:

each of said pins is coupled to a respective one of said at least one cam by a carrier which is rotatably mounted on said cam, and said pins are connected to said carrier.

5. A fuel injection pump according to claim 2, wherein:

each of said pins which is secured to a respective said pumping plunger is coupled to a respective one of said at least one cam by a carrier which is rotatably mounted on a respective one of said at least one said cam, each of said pins being connected to said carrier.

6. A fuel injection pump according to claim 5, wherein:

said carrier has a flat sliding surface, and each said pin has means for engaging said flat sliding surface.

7. A fuel injection pump according to claim 5, wherein:

said carrier has a flat sliding surface, and each said pin directly engages said flat sliding surface.

8. A fuel injection pump according to claim 6, wherein:

said means for engaging includes a plurality of sliding shoes, wherein each said pin is secured to a respective said sliding shoe which contacts said sliding surface of said carrier.

9. A fuel injection pump according to claim 8, further comprising:

means for maintaining each said sliding shoe in contact with said sliding surface during filling strokes of said plungers.

10. A fuel injection pump according to claim 9, wherein:

said means for maintaining comprises at least one spring clip for each said sliding shoe, each said spring clip secured to said carrier and engaging a respective said sliding shoe.

11. A fuel pump according to claim 1, wherein:

each said pumping chamber has a first end and a second end and each said pumping plunger has a first end which forms a first end enclosure of a respective said pumping chamber, said first end of each said pumping plunger having a blind bore which axially extends into said pumping plunger and defines an annular skirt at said first end of said pumping plunger, said blind bore having a surface, whereby fuel pressure in said respective pumping chamber applies a force radially outwardly to said surface of said blind bore.

12. A fuel pump for delivering high pressure fuel, comprising:

a) a cylinder defining a pumping chamber, said pumping chamber having a first end and a second end;

b) at least one pumping plunger mounted in said cylinder, said pumping plunger having a first end which forms a first end enclosure of said pumping chamber;

c) drive means for reciprocatingly driving said pumping plunger through delivery strokes and filling strokes within said cylinder to vary a volume of said pumping chamber;

d) a delivery valve openable by fuel pressure in said pumping chamber to permit delivery of the high pressure fuel therefrom; and e) a holding means for selectively maintaining said delivery valve open at an end of each said delivery stroke of said pumping plunger, whereby a selected proportion of the high pressure fuel delivered through said delivery valve during each said delivery stroke of said pumping plunger is allowed to return to said pumping chamber during a succeeding filling stroke of said plunger.

13. A fuel pump according to claim 12, wherein:

said at least one pumping plunger comprises a plurality of pumping plungers.

14. A fuel pump according to claim 13, wherein:

said plurality of pumping plungers comprises exactly three pumping plungers.

15. A fuel pump according to claim 14, wherein:

said holding means comprises an electromagnet adapted to hold said delivery valve in an open position.

16. A fuel pump according to claim 13, wherein:

said holding means comprises an electromagnet adapted to hold said delivery valve in an open position.

17. A fuel pump according to claim 12, wherein:

said holding means comprises an electromagnet adapted to hold said delivery valve in an open position.

* * * * *